US012600451B2

(12) United States Patent
Watanabe

(10) Patent No.: US 12,600,451 B2
(45) Date of Patent: Apr. 14, 2026

(54) MARINE PROPULSION SYSTEM, OUTBOARD MOTOR, AND MARINE VESSEL

(71) Applicant: YAMAHA HATSUDOKI KABUSHIKI KAISHA, Iwata (JP)

(72) Inventor: Masahisa Watanabe, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 211 days.

(21) Appl. No.: 17/467,695

(22) Filed: Sep. 7, 2021

(65) Prior Publication Data

US 2022/0081089 A1 Mar. 17, 2022

(30) Foreign Application Priority Data

Sep. 16, 2020 (JP) ..... 2020-155362

(51) Int. Cl.
*B63H 21/20* (2006.01)
*B63H 20/32* (2006.01)

(52) U.S. Cl.
CPC ..... *B63H 21/20* (2013.01); *B63H 20/32* (2013.01); *B63H 2021/205* (2013.01)

(58) Field of Classification Search
CPC ..... B63H 21/20; B63H 20/32
USPC ..... 440/53
See application file for complete search history.

(56) References Cited

U.S. PATENT DOCUMENTS 5,146,095 A * 9/1992 Tsuchiya ..... F02N 11/0866 290/38 R
5,498,951 A * 3/1996 Okamura ..... H02J 7/345 322/2 R
5,818,115 A 10/1998 Nagao
5,878,687 A * 3/1999 Grimmeisen ..... B63C 11/46 440/6
9,004,961 B1 * 4/2015 French ..... B63H 20/00 320/125
2003/0139859 A1 * 7/2003 Hanada ..... B60L 58/10 701/22
2004/0090195 A1 * 5/2004 Motsenbocker ..... B60L 58/25 318/109
2005/0099155 A1 * 5/2005 Okuda ..... H02J 7/1438 320/162

(Continued)

FOREIGN PATENT DOCUMENTS

JP 07201681 A * 8/1995
JP 2000139041 A * 5/2000 ..... B63J 3/04

(Continued)

OTHER PUBLICATIONS

Official Communication issued in corresponding European Patent Application No. 21196291.5, mailed on Feb. 8, 2022.

*Primary Examiner* — Logan M Kraft
*Assistant Examiner* — Joshua Campbell
(74) *Attorney, Agent, or Firm* — Keating & Bennett, LLP

(57) ABSTRACT

A marine propulsion system includes an outboard motor including an outboard motor engine, a propulsion generator to be driven by the outboard motor engine, and an electric starter to start the outboard motor engine. The outboard motor is installed on a hull, and an outboard motor capacitor is provided in the outboard motor to supply to the starter power to start the outboard motor engine. The outboard motor capacitor has a higher output per unit volume than a lead storage battery.

20 Claims, 8 Drawing Sheets

FIRST PREFERRED EMBODIMENT

(56) References Cited

U.S. PATENT DOCUMENTS

| | | | | |
|---|---|---|---|---|
| 2007/0120694 | A1* | 5/2007 | Lindsey | G01R 19/16538 340/662 |
| 2009/0061705 | A1* | 3/2009 | Wiatrowski | F02N 11/0862 440/85 |
| 2012/0286791 | A1* | 11/2012 | Tanaya | F02P 17/12 324/393 |
| 2013/0119923 | A1* | 5/2013 | Wright | H02J 7/345 320/166 |
| 2019/0039707 | A1* | 2/2019 | Ezaki | B63J 99/00 |
| 2019/0311553 | A1 | 10/2019 | Kawase | |
| 2019/0338718 | A1* | 11/2019 | Buis | F02N 11/0822 |
| 2020/0182216 | A1* | 6/2020 | Yoshikawa | F16H 59/105 |

FOREIGN PATENT DOCUMENTS

| | | | |
|---|---|---|---|
| JP | 2015-063933 | A | 4/2015 |
| JP | 2019-185196 | A | 10/2019 |

* cited by examiner

FIRST PREFERRED EMBODIMENT

FIRST PREFERRED EMBODIMENT

FIRST PREFERRED EMBODIMENT

FIRST PREFERRED EMBODIMENT

FIRST PREFERRED EMBODIMENT

SECOND PREFERRED EMBODIMENT

MARINE PROPULSION SYSTEM, OUTBOARD MOTOR, AND MARINE VESSEL

CROSS REFERENCE TO RELATED APPLICATIONS

This application claims the benefit of priority to Japanese Patent Application No. 2020-155362 filed on Sep. 16, 2020. The entire contents of this application are hereby incorporated herein by reference.

BACKGROUND OF THE INVENTION

1. Field of the Invention

The present invention relates to a marine propulsion system, an outboard motor, and a marine vessel.

2. Description of the Related Art

A marine propulsion system, an outboard motor, and a marine vessel each including an electric starter to start an engine are known in general. Such a marine propulsion system, an outboard motor, and a marine vessel are disclosed in Japanese Patent Laid-Open No. 2019-185196, for example.

Japanese Patent Laid-Open No. 2019-185196 discloses an outboard motor including an engine to drive a propulsion generator and an electric starter to start the engine. The starter is electrically connected to a battery provided on the hull, and starts the engine by a supply of power from the battery on the hull to the starter.

Although not clearly described in Japanese Patent Laid-Open No. 2019-185196, in a conventional outboard motor as described in Japanese Patent Laid-Open No. 2019-185196, a lead storage battery is often used as a battery on the hull used by a starter to start an engine. The lead storage battery has a property indicating that "an output per unit volume is relatively low". Therefore, in the conventional outboard motor, a lead storage battery having a relatively large size is mounted as a battery on the hull such that a higher output is obtained, a relatively large space in a hull tends to be occupied by the lead storage battery, and further expansion of a space in the hull is required. Furthermore, the lead storage battery has a property indicating that "a decrease in output due to a decrease in charging rate (SOC: state of charge) is relatively large (a range of a charging rate at which the engine is able to be started is relatively small)" and "a decrease in maximum output due to repeated charging is relatively large (the lead storage battery is relatively easy to deteriorate)". Therefore, in the conventional outboard motor, further improvement in starting the engine is desired.

SUMMARY OF THE INVENTION

Preferred embodiments of the present invention provide marine propulsion systems, outboard motors, and marine vessels that each increase the space for devices on the hull without expanding the space on the hull and improve the starting of the outboard motor engine.

A marine propulsion system according to a preferred embodiment of the present invention includes an outboard motor including an outboard motor engine, a propulsion generator to be driven by the outboard motor engine, and an electric starter to start the outboard motor engine, the outboard motor being installed on a hull, and an outboard motor capacitor provided in the outboard motor to supply to the starter power to start the outboard motor engine, the outboard motor capacitor having a higher output per unit volume than a lead storage battery.

A marine propulsion system according to a preferred embodiment of the present invention includes the outboard motor capacitor provided in the outboard motor to supply to the starter the power to start the outboard motor engine, and having a higher output per unit volume than the lead storage battery. Accordingly, the outboard motor capacitor having a higher output per unit volume than the lead storage battery supplies to the starter the power to start the outboard motor engine, and thus while an output equal or substantially equal to that of the lead storage battery is provided, a power source (outboard motor capacitor) for the starter is downsized and installed in the outboard motor. Consequently, it is not necessary to provide a power source for the starter on the hull, and thus a space for a device on the hull is increased without expanding the space in the hull.

In general, a capacitor has a property such that, a decrease in output due to a decrease in charging rate is smaller (a range of a charging rate at which the outboard motor engine is able to be started is larger) and a decrease in maximum output due to repeated charging is smaller (the capacitor is harder to deteriorate) as compared with a lead storage battery. Therefore, as compared with the lead storage battery, the starting of the outboard motor engine is improved. Thus, a space for the device on the hull is increased without expanding the space in the hull, and the starting of the outboard motor engine is improved. Furthermore, the outboard motor capacitor is located in the outboard motor such that it is not necessary to provide a wiring (a wiring to directly supply to the starter power to start the outboard motor engine) so as to extend between the hull and the outboard motor. Thus, a complex operation such as routing of the wiring is eliminated, and a load (stress) applied to the wiring at the time of steering is prevented.

In a marine propulsion system according to a preferred embodiment of the present invention, the outboard motor preferably further includes a cowling to house the outboard motor engine, and the outboard motor capacitor is preferably provided in the cowling. Accordingly, the outboard motor capacitor is located in the cowling in the uppermost portion of the outboard motor, and thus adhesion of water to the outboard motor capacitor is prevented.

A marine propulsion system according to a preferred embodiment of the present invention preferably further includes an outboard motor controller provided in the outboard motor and configured or programmed to control driving of the outboard motor engine, and a generator provided in the outboard motor to generate power due to the driving of the outboard motor engine, and the outboard motor controller is preferably configured or programmed to perform a control to supply, from the generator to the outboard motor capacitor, power to charge the outboard motor capacitor during the driving of the outboard motor engine. Accordingly, the outboard motor capacitor is charged by the generator during the driving of the outboard motor engine, and thus the outboard motor engine is continuously and repeatedly started by the outboard motor capacitor.

In such a case, a marine propulsion system according to a preferred embodiment of the present invention preferably further includes a hull-side battery provided on a hull and electrically connected to the outboard motor capacitor, and the outboard motor controller is preferably configured or programmed to perform a control to supply, from the hull-side battery to the outboard motor capacitor, the power to charge the outboard motor capacitor before the driving of the outboard motor engine. Accordingly, when the outboard motor capacitor is discharged while the outboard motor engine is stopped and the charging rate of the outboard motor capacitor is decreased, for example, the outboard motor capacitor is charged by the hull-side battery even before the outboard motor engine is driven although the outboard motor capacitor is not charged by the generator. Consequently, the starting of the outboard motor engine is further improved. The hull-side battery is provided, and thus a wiring (a wiring connected to the hull-side battery) that extends between the hull and the outboard motor is required. However, power output via the wiring is not the power to start the outboard motor engine but the power to charge the outboard motor capacitor having a lower output than the power to start the outboard motor engine, and thus a relatively thin wiring is used as the wiring connected to the hull-side battery. Therefore, an operation such as routing of the wiring is relatively easy, and a load (stress) applied to the wiring at the time of steering is relatively decreased.

A marine propulsion system including the hull-side battery preferably further includes a voltage sensor provided in the outboard motor to detect a voltage value of the outboard motor capacitor, and the outboard motor controller is preferably configured or programmed to perform a control to supply, from the outboard motor capacitor to the starter, the power to start the outboard motor engine when the voltage value of the outboard motor capacitor is equal to or greater than a first threshold; to supply, from the hull-side battery to the outboard motor capacitor, the power to charge the outboard motor capacitor when the voltage value of the outboard motor capacitor is less than the first threshold; and to supply, from the outboard motor capacitor to the starter, the power to start the outboard motor engine when the voltage value of the outboard motor capacitor becomes equal to or greater than the first threshold before a first time elapses after the supply of the power to charge the outboard motor capacitor from the hull-side battery is started. Accordingly, after the voltage value of the outboard motor capacitor is increased to a value that is equal to or greater than the first threshold such that the outboard motor engine is reliably started by charging that requires a maximum of the first time, the outboard motor capacitor supplies to the starter the power to start the outboard motor engine.

In a marine propulsion system including the outboard motor controller configured or programmed to perform a control based on the first threshold and the first time, the outboard motor controller is preferably configured or programmed to perform a control to continuously supply, from the hull-side battery to the outboard motor capacitor, the power to charge the outboard motor capacitor when the voltage value of the outboard motor capacitor is less than the first threshold at an expiration of the first time, and to supply, from the outboard motor capacitor to the starter, the power to start the outboard motor engine when the voltage value of the outboard motor capacitor becomes equal to or greater than a second threshold that is smaller than the first threshold before a second time that is longer than the first time elapses after the supply of the power to charge the outboard motor capacitor from the hull-side battery is started. Accordingly, even when the voltage value of the outboard motor capacitor is not increased to a value that is equal to or greater than the first threshold by charging, the outboard motor capacitor supplies to the starter the power to start the outboard motor engine after the voltage value of the outboard motor capacitor is increased to a value that is equal to or greater than the second threshold such that the starting of the outboard motor engine is provided by charging that requires a maximum of the second time.

In a marine propulsion system including the outboard motor controller configured or programmed to perform a control based on the second threshold and the second time, the outboard motor controller is preferably configured or programmed to perform a control to continuously supply, from the hull-side battery to the outboard motor capacitor, the power to charge the outboard motor capacitor when the voltage value of the outboard motor capacitor is less than the second threshold at an expiration of the second time, and to supply, from the outboard motor capacitor to the starter, the power to start the outboard motor engine when the voltage value of the outboard motor capacitor becomes equal to or greater than a third threshold that is smaller than the second threshold before a third time that is longer than the second time elapses after the supply of the power to charge the outboard motor capacitor from the hull-side battery is started. Accordingly, even when the voltage value of the outboard motor capacitor is not increased to a value that is equal to or greater than the second threshold by charging, the outboard motor capacitor supplies to the starter the power to start the outboard motor engine after the voltage value of the outboard motor capacitor is increased to a value that is equal to or greater than the third threshold such that the starting of the outboard motor engine is provided by charging that requires a maximum of the third time.

In a marine propulsion system including the outboard motor controller configured or programmed to perform a control based on the third threshold and the third time, the outboard motor controller is preferably configured or programmed to perform a control to supply, from the hull-side battery to the outboard motor capacitor, the power to charge the outboard motor capacitor, and to interrupt the start of the outboard motor engine when it is determined that the voltage value of the outboard motor capacitor detected by the voltage sensor does not become equal to or greater than a lower limit threshold that is smaller than the third threshold as a result of the supply of the power to charge the outboard motor capacitor from the hull-side battery. Accordingly, even when charging is continued, it is determined at the appropriate timing that it is difficult to set the voltage value (charging rate) of the outboard motor capacitor to be equal to or greater than the lower limit threshold (the lower limit voltage value at which the outboard motor engine is started), and the start of the outboard motor engine is interrupted.

A marine propulsion system including the outboard motor controller configured or programmed to perform a control based on the first threshold and the first time preferably further includes a DC-DC converter provided in the outboard motor to boost a DC voltage supplied from the hull-side battery to the outboard motor capacitor to charge the outboard motor capacitor, and the outboard motor controller is preferably configured or programmed to stop the supply of the power to charge the outboard motor capacitor from the hull-side battery by stopping the DC-DC converter. Accordingly, the DC-DC converter is stopped (turned off) such that the outboard motor capacitor supplies to the starter the power to start the outboard motor engine while a cutoff between the hull-side battery and the outboard motor capacitor is provided. Therefore, when power is supplied to start the outboard motor engine, the waste of power output to the hull-side battery via the DC-DC converter is eliminated.

In a marine propulsion system including the outboard motor controller configured or programmed to perform a control based on the first threshold and the first time, the hull-side battery is preferably a dedicated capacitor battery to supply, to the outboard motor capacitor, the power to charge the outboard motor capacitor. Accordingly, the power of the hull-side battery is not consumed except for the purpose of charging the outboard motor capacitor, and the power consumption of the hull-side battery is significantly reduced. Consequently, the outboard motor capacitor is more reliably charged by the hull-side battery, and thus the starting of the outboard motor engine is further improved.

In such a case, the capacitor battery preferably includes the lead storage battery. Unlike a conventional lead storage battery on the hull used for a high output to directly supply, to a starter, power to start an outboard motor engine, the lead storage battery on the hull according to preferred embodiments of the present invention is used for a low output to supply, to the outboard motor capacitor, the power to charge the outboard motor capacitor, and thus the size of the lead storage battery is relatively decreased. Therefore, with the structure described above, even when the lead storage battery is provided on the hull, the lead storage battery is small, and thus a space for the device on the hull is increased without expanding the space in the hull.

In a marine propulsion system including the outboard motor controller configured or programmed to perform a control based on the first threshold and the first time, the hull-side battery preferably supplies power to a device on the hull. Accordingly, the hull-side battery is used both to charge the outboard motor capacitor and to drive a device on the hull (so-called house device).

In a marine propulsion system including the hull-side battery, the outboard motor controller is preferably configured or programmed to provide a notification to a user that the starter is attempting to start the outboard motor engine based on a user's predetermined starting operation to start the outboard motor engine. Accordingly, when it takes time to charge the outboard motor capacitor with the hull-side battery, for example, the user recognizes that the outboard motor engine is in the process of being started due to the notification, and thus the user is prevented from erroneously believing that the outboard motor engine is defective, for example.

A marine propulsion system according to a preferred embodiment of the present invention preferably further includes a relay switch to switch between an energization state and a cutoff state between the outboard motor capacitor and the starter. Accordingly, the relay switch is maintained in the cutoff state while the outboard motor engine is stopped such that the dark current of the outboard motor capacitor (discharging from the outboard motor capacitor) is suppressed.

In a marine propulsion system according to a preferred embodiment of the present invention, the outboard motor capacitor is preferably electrically connectable to an auxiliary power source, and the auxiliary power source preferably supplies to the outboard motor capacitor power to charge the outboard motor capacitor. Accordingly, when the outboard motor capacitor is discharged while the outboard motor engine is stopped and the charging rate is decreased, for example, the outboard motor capacitor is charged by the auxiliary power source. Consequently, the starting of the outboard motor engine is further improved.

An outboard motor according to a preferred embodiment of the present invention includes an outboard motor engine, a propulsion generator to be driven by the outboard motor engine, an electric starter to start the outboard motor engine, and an outboard motor capacitor to supply to the starter power to start the outboard motor engine, the outboard motor capacitor having a higher output per unit volume than a lead storage battery.

An outboard motor according to a preferred embodiment of the present invention includes the outboard motor capacitor to supply to the starter the power to start the outboard motor engine, wherein the outboard motor capacitor has a higher output per unit volume than the lead storage battery. Accordingly, the outboard motor capacitor having a higher output per unit volume than the lead storage battery supplies to the starter the power to start the outboard motor engine, and thus while an output equal or substantially equal to that of the lead storage battery is provided, a power source (outboard motor capacitor) for the starter is downsized and installed in the outboard motor. Consequently, it is not necessary to provide a power source for the starter on the hull, and thus a space for a device on the hull is increased without expanding the space in the hull. In general, a capacitor has a property such that a decrease in output due to a decrease in charging rate is smaller (a range of a charging rate at which the outboard motor engine is able to be started is larger) and a decrease in maximum output due to repeated charging is smaller (the capacitor is harder to deteriorate) as compared with a lead storage battery. Therefore, as compared with the lead storage battery, the starting of the outboard motor engine is improved. Thus, a space for the device on the hull is increased without expanding the space in the hull, and the starting of the outboard motor engine is improved. Furthermore, the outboard motor capacitor is located in the outboard motor such that it is not necessary to provide a wiring (a wiring to directly supply to the starter power to start the outboard motor engine) so as to extend between the hull and the outboard motor. Thus, a complex operation such as routing of the wiring is eliminated, and a load (stress) applied to the wiring at the time of steering is prevented.

An outboard motor according to a preferred embodiment of the present invention preferably further includes a cowling to house the outboard motor engine, and the outboard motor capacitor is preferably provided in the cowling. Accordingly, the outboard motor capacitor is located in the cowling in the uppermost portion of the outboard motor, and thus adhesion of water to the outboard motor capacitor is prevented.

An outboard motor according to a preferred embodiment of the present invention preferably further includes an outboard motor controller configured or programmed to control driving of the outboard motor engine, and a generator to generate power by the driving of the outboard motor engine, and the outboard motor controller is preferably configured or programmed to perform a control to supply, from the generator to the outboard motor capacitor, power to charge the outboard motor capacitor during the driving of the outboard motor engine. Accordingly, the outboard motor capacitor is charged by the generator during the driving of the outboard motor engine, and thus the outboard motor engine is continuously and repeatedly started by the outboard motor capacitor.

A marine vessel according to a preferred embodiment of the present invention includes a hull, an outboard motor including an outboard motor engine, a propulsion generator to be driven by the outboard motor engine, and an electric starter to start the outboard motor engine, the outboard motor being installed on the hull, and an outboard motor capacitor provided in the outboard motor to supply to the starter power to start the outboard motor engine, the outboard motor capacitor having a higher output per unit volume than a lead storage battery.

A marine vessel according to a preferred embodiment of the present invention includes the outboard motor capacitor provided in the outboard motor to supply to the starter the power to start the outboard motor engine, and having a higher output per unit volume than the lead storage battery. Accordingly, the outboard motor capacitor having a higher output per unit volume than the lead storage battery supplies to the starter the power to start the outboard motor engine, and thus while an output equal or substantially equal to that of the lead storage battery is provided, a power source (outboard motor capacitor) for the starter is downsized and installed in the outboard motor. Consequently, it is not necessary to provide a power source for the starter on the hull, and thus a space for the device on the hull is increased without expanding the space in the hull. In general, a capacitor has a property such that a decrease in output due to a decrease in charging rate is smaller (a range of a charging rate at which the outboard motor engine is able to be started is larger) and a decrease in maximum output due to repeated charging is smaller (the capacitor is harder to deteriorate) as compared with a lead storage battery. Therefore, as compared with the lead storage battery, the starting of the outboard motor engine is improved. Thus, a space for the device on the hull is increased without expanding the space in the hull, and the starting of the outboard motor engine is improved. Furthermore, the outboard motor capacitor is located in the outboard motor such that it is not necessary to provide a wiring (a wiring to directly supply to the starter power to start the outboard motor engine) so as to extend between the hull and the outboard motor. Thus, a complex operation such as routing of the wiring is eliminated, and a load (stress) applied to the wiring at the time of steering is prevented.

In a marine vessel according to a preferred embodiment of the present invention, the outboard motor preferably further includes a cowling to house the outboard motor engine, and the outboard motor capacitor is preferably provided in the cowling. Accordingly, the outboard motor capacitor is located in the cowling located in the uppermost portion of the outboard motor, and thus adhesion of water to the outboard motor capacitor is prevented.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of a marine vessel 100 according to a first preferred embodiment of the present invention is now described with reference to FIGS. 1 to 6. In the figures, arrow FWD represents the forward movement direction of the marine vessel 100, and arrow BWD represents the reverse movement direction of the marine vessel 100.

Figure 1:
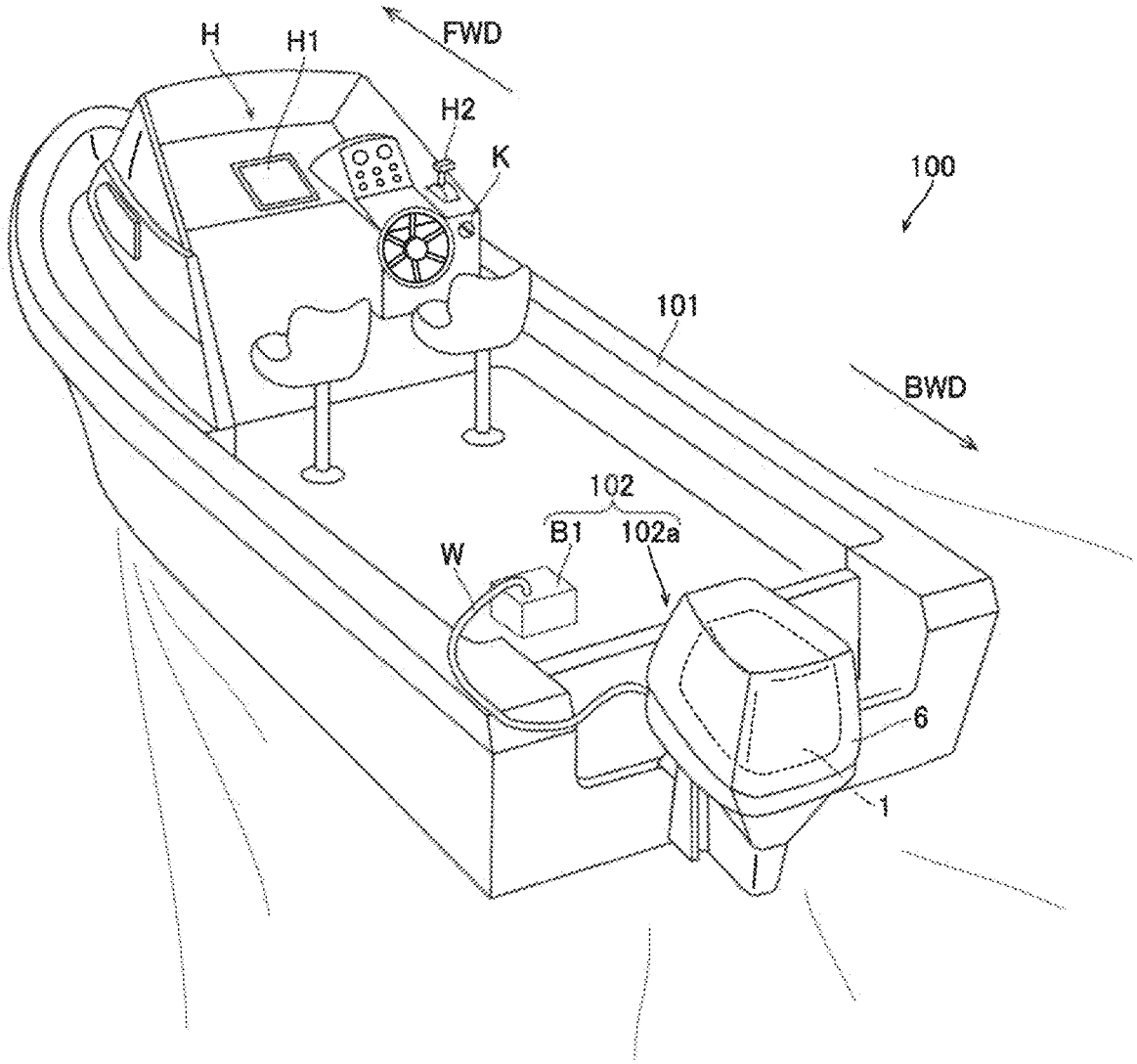
FIG. 1 is a perspective view showing a marine vessel including a marine propulsion system according to a first preferred embodiment of the present invention.

As shown in FIG. 1, the marine vessel 100 includes a hull 101 and a marine propulsion system 102 provided on the hull 101.

The marine propulsion system 102 includes an outboard motor 102*a* and a lead storage battery B1. The lead storage battery B1 is provided on the hull 101 and is electrically connected to an outboard motor capacitor (condenser) 7 (see FIG. 2) of the outboard motor 102*a* described below. The outboard motor 102*a* is installed at the stern (transom) of the hull 101. That is, the marine vessel 100 is an outboard motor boat. The lead storage battery B1 is an example of a "capacitor battery" or a "hull-side battery".

The hull 101 includes the lead storage battery B1 electrically connected to the outboard motor capacitor 7 of the outboard motor 102*a* described below, a house device H including various devices such as a display H1 and a marine vessel maneuvering device H2 to control the propulsion direction of the hull 101, a hull controller (not shown), and a key switch K. The house device H is an example of a "device on the hull".

The hull controller controls each portion of the hull 101 and performs a control to transmit a signal related to marine vessel maneuvering, a signal related to the house device H, etc., to the outboard motor 102*a*. The house device H is provided in a circuit separate from a circuit including the lead storage battery B1 and the outboard motor capacitor 7, and power is supplied to the house device H from another power source (not shown) other than the lead storage battery B1 and the outboard motor capacitor 7.

Figure 2:
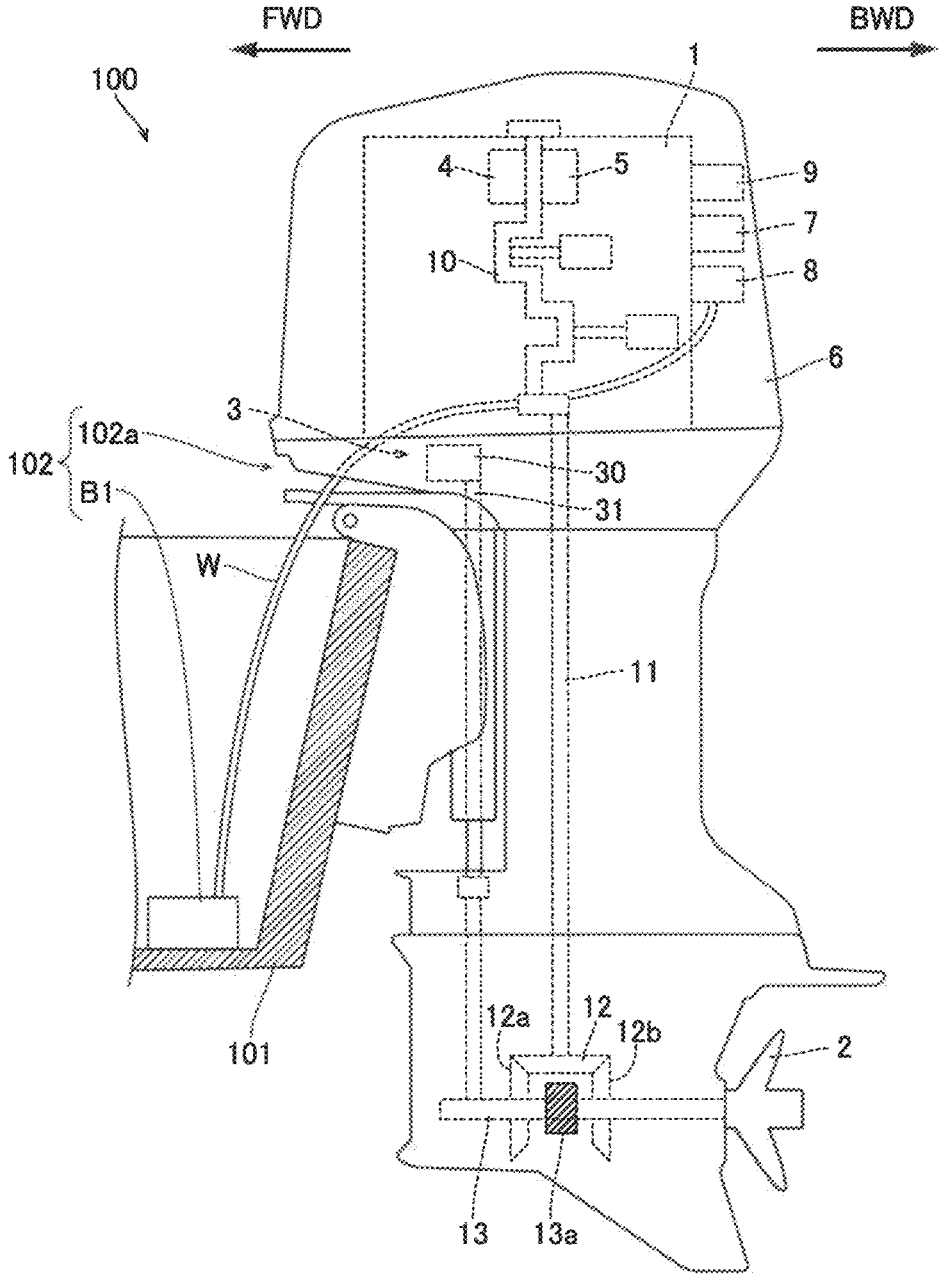
FIG. 2 is a side view illustrating the structure of an outboard motor according to the first preferred embodiment of the present invention.

As shown in FIG. 2, the lead storage battery B1 is electrically connected to a first end of a wiring W in the hull 101. A second end of the wiring W is electrically connected to a DC-DC converter 8 of the outboard motor 102*a* described below in a cowling 6 of the outboard motor 102*a*. The lead storage battery B1 supplies, to the outboard motor capacitor 7 via the DC-DC converter 8, power to charge the outboard motor capacitor 7 before an outboard motor engine 1 is started (driven). Power is supplied to the lead storage battery B1 from a generator 5 of the outboard motor engine 1 described below to charge the lead storage battery B1 when the outboard motor engine 1 is started and driven.

The expression "starting the outboard motor engine 1" refers to "supplying, from the lead storage battery B1 in the hull 101 to the outboard motor capacitor 7, power to charge the outboard motor capacitor 7" and "supplying, from the outboard motor capacitor 7 to a starter 4, power to start (crank) the outboard motor engine 1". "Supplying, from the lead storage battery B1 in the hull 101 to the outboard motor capacitor 7, power to charge the outboard motor capacitor 7" is performed in advance when the voltage value of the outboard motor capacitor 7 is less than a first threshold described below before "supplying, from the outboard motor capacitor 7 to the starter 4, power to start the outboard motor engine 1".

The lead storage battery B1 according to the first preferred embodiment is used only to charge the outboard motor capacitor 7, and is not used for other purposes such as directly supplying, to the starter 4 for the outboard motor engine 1, power to start (crank) the outboard motor engine 1 and supplying, to the house device H, power to drive the house device H.

Figure 3:
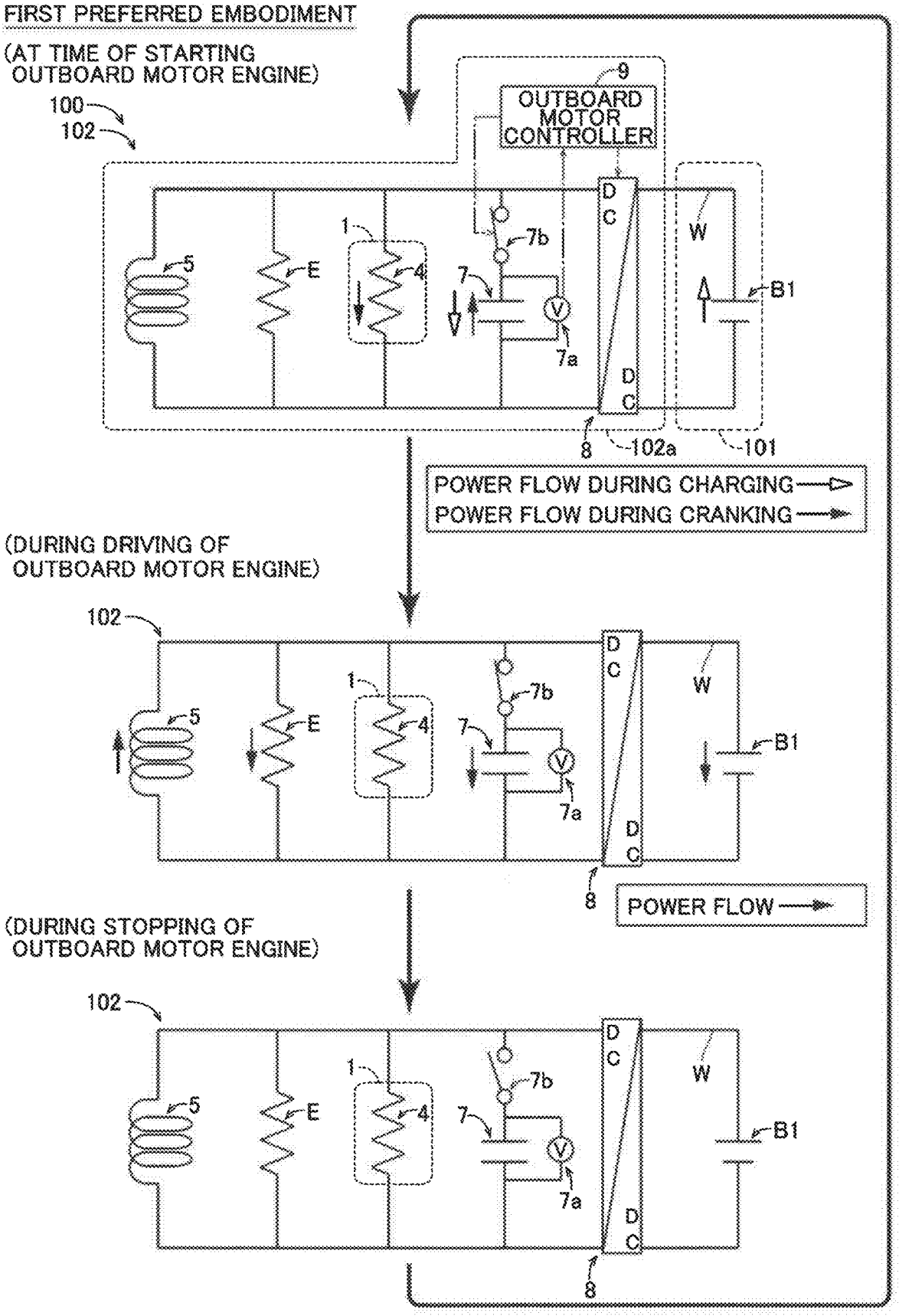
FIG. 3 is a diagram schematically showing a circuit including an outboard motor capacitor of the marine propulsion system and a starter for an outboard motor engine according to the first preferred embodiment of the present invention.

As shown in FIGS. 2 and 3, the outboard motor 102*a* includes the outboard motor engine 1, a propulsion generator 2, a shift device 3, the starter 4, the generator 5, the cowling 6, the outboard motor capacitor 7, a voltage sensor 7*a*, a relay switch 7*b*, the DC-DC converter 8, and an outboard motor controller 9.

The outboard motor engine 1 drives the propulsion generator 2. The propulsion generator 2 includes a propeller to generate a propulsive force by rotation.

The outboard motor engine 1 is an internal combustion engine driven by explosive combustion of fuel. The outboard motor 102*a* transmits a driving force (torque) from a crankshaft 10 of the outboard motor engine 1 to a drive shaft 11, an intermediate gear 12, a drive gear (one of a forward gear 12*a* and a reverse gear 12*b*), a clutch 13*a*, and a propeller shaft 13 in this order to rotate the propulsion generator 2.

Specifically, the intermediate gear 12 is provided at the lower end of the drive shaft 11 that extends in an upward-downward direction. The intermediate gear 12 is positioned between the forward gear 12*a* positioned on the front side and the reverse gear 12*b* positioned on the rear side in a forward-rearward direction. The intermediate gear 12 constantly meshes with the forward gear 12*a* and the reverse gear 12*b*. The intermediate gear 12, the forward gear 12*a*, and the reverse gear 12*b* are all bevel gears. The forward gear 12*a* and the reverse gear 12*b* rotate in opposite directions on a central axis coaxial with the rotation central axis of the propeller shaft 13.

The clutch 13*a* is a dog clutch. The clutch 13*a* is provided on the propeller shaft 13 and rotates together with the propeller shaft 13. The clutch 13*a* is sandwiched between the forward gear 12*a* and the reverse gear 12*b* in the forward-rearward direction.

The clutch 13*a* is moved in the forward-rearward direction by the shift device 3 to switch the outboard motor 102*a* to one of three driving states including a "neutral state", a "forward movement state (non-neutral state)", and a "reverse movement state (non-neutral state)".

The "neutral state" refers to a state in which the clutch 13*a* is located at an intermediate position spaced apart from the forward gear 12*a* and the reverse gear 12*b* so as to not mesh with the forward gear 12*a* and the reverse gear 12*b*, and an idling state in which a driving force is not transmitted from the outboard motor engine 1 to the propeller shaft 13. As an example, in the idling state, the outboard motor engine 1 idles without transmitting a driving force to the propulsion generator 2 while rotating at a rotation speed of about 500 rpm or more and about 600 rpm or less, for example.

The "forward movement state" refers to a state in which the clutch 13*a* is moved forward, the clutch 13*a* meshes only with the forward gear 12*a*, and the marine vessel 100 moves forward. The "reverse movement state" refers to a state in which the clutch 13*a* is moved rearward, the clutch 13*a* meshes only with the reverse gear 12*b*, and the marine vessel 100 moves rearward.

The shift device 3 includes a shift operator (not shown) including an operation lever operated by a user, a shift actuator 30, and a shift shaft 31. The shift actuator 30 receives, from the shift operator via the outboard motor controller 9, a predetermined signal to switch the shift. Consequently, the shift actuator 30 moves the shift shaft 31 in the forward-rearward direction to switch the outboard motor 102*a* to one of the three driving states including the "neutral state", the "forward movement state", and the "reverse movement state".

The starter 4 is an electric starter to start the outboard motor engine 1. The starter 4 includes a starter motor. Alternatively, the starter may include a flywheel magnet or an integrated starter generator (ISG) such as an alternator.

The generator 5 generates power due to driving of the outboard motor engine 1. That is, the generator 5 is a so-called alternating current (AC) generator to generate power as the crankshaft 10 rotates. The generator 5 includes an alternator. Alternatively, the generator 5 may include a flywheel magnet, for example, instead of an alternator. The generator 5 includes an inverter (not shown) to convert a generated alternating current into a direct current.

The cowling 6 is a removable housing cover to house the outboard motor engine 1. In addition to the outboard motor engine 1, the starter 4, the generator 5, the outboard motor capacitor 7, the voltage sensor 7*a*, the relay switch 7*b*, the outboard motor controller 9, etc. are located in the cowling 6. The cowling 6 is located in the uppermost portion among all components of the outboard motor 102*a*. The cowling 6 covers various structures such as the outboard motor capacitor 7 located in the cowling 6 such that water does not adhere to the various structures.

The outboard motor capacitor 7 includes a power storage device such as an electric double-layer capacitor or a lithium-ion capacitor, which has a higher power density than the lead storage battery B1. Alternatively, the outboard motor capacitor 7 may include a capacitor including an electrode, for example, made of a different material from those of an electric double-layer capacitor and a lithium-ion capacitor.

The outboard motor capacitor 7 is located in the outboard motor 102*a*. Specifically, the outboard motor capacitor 7 is located in the cowling 6.

The outboard motor capacitor 7 is electrically connected to the lead storage battery B1 in the hull 101 via the DC-DC converter 8 and the wiring W. The outboard motor capacitor 7 is electrically connected to the starter 4 in the outboard motor 102*a*. The outboard motor capacitor 7 is electrically connected to an electrical component E of the outboard motor engine 1 in the outboard motor 102*a*. The outboard motor capacitor 7 is electrically connected to the generator 5 in the outboard motor 102*a*. The outboard motor capacitor 7 is connected in parallel to the lead storage battery B1, the starter 4, the electrical component E, and the generator 5 in the circuit. The electrical component E includes various circuit configurations such as the outboard motor controller 9.

Before the outboard motor engine 1 is started, power is supplied from the lead storage battery B1 to the outboard motor capacitor 7 via the DC-DC converter 8 and the wiring W as needed to charge the outboard motor capacitor 7. The outboard motor capacitor 7 supplies to the starter 4 power to start (crank) the outboard motor engine 1. Furthermore, the outboard motor capacitor 7 supplies, to the electrical component E, power to drive the electrical component E.

In conventional outboard motors, lead storage batteries are often used to start engines. In general, lead storage batteries have a characteristic (characteristic of being easily deteriorated) such that the discharge capacity (output) tends to be particularly small due to repeated charging as compared with various capacitors. Therefore, lead storage batteries need to be replaced at a relatively early stage in order to reliably start engines. Unlike secondary batteries such as lead storage batteries, capacitors have a characteristic that they are charged and discharged instantly.

Lead storage batteries have a higher SOC (state of charge: charging rate) required to reliably start engines than various capacitors. As an example, although lead storage batteries have an SOC of about 80% or more required to reliably start engines, capacitors are able to start engines until an SOC of about 0%. Therefore, in conventional outboard motors, it is necessary to provide lead storage batteries with a relatively large size in hulls to start engines.

As described above, the lead storage battery B1 according to the first preferred embodiment is not used to directly supply, to the starter 4 for the outboard motor engine 1, power to start (crank) the outboard motor engine 1 but used only to charge the outboard motor capacitor 7. Therefore, the lead storage battery B1 is smaller in size than lead storage batteries provided in hulls to start engines for conventional outboard motors. Only "power to charge the outboard motor capacitor 7" not "power to start the outboard motor engine 1" is supplied to the wiring W that connects the DC-DC converter 8 to the lead storage battery B1 in the hull 101. The "power to charge the outboard motor capacitor 7" has a lower output than the "power to start the outboard motor engine 1". Therefore, the wiring W used to supply the "power to charge the outboard motor capacitor 7" is relatively thin in consideration of the resistance to voltage.

When the wiring W that connects the outboard motor 102*a* to the lead storage battery B1 in the hull 101 is thin, various advantages such as reducing a load applied to the wiring W when the outboard motor 102*a* is steered, facilitating steering of the outboard motor 102*a*, facilitating bending of the wiring W and facilitating routing of the wiring W, and making the wiring W inconspicuous and making the appearance of the outboard motor 102*a* including the wiring W preferable from a design point of view are obtained.

Figure 4:
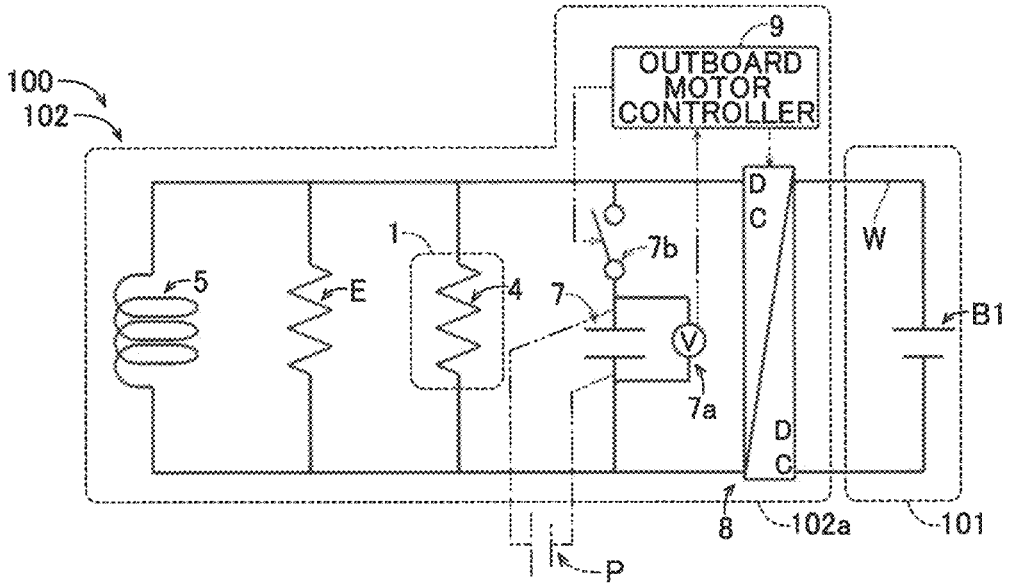
FIG. 4 is a diagram schematically showing a state in which an auxiliary power source is connected to the circuit including the outboard motor capacitor of the marine propulsion system and the starter for the outboard motor engine according to the first preferred embodiment of the present invention.

The outboard motor capacitor 7 is electrically connectable to a detachable auxiliary power source P (see FIG. 4). Power is supplied from the auxiliary power source P to the outboard motor capacitor 7 to charge the outboard motor capacitor 7. The auxiliary power source P is used when power required to charge the outboard motor capacitor 7 is not able to be supplied from the lead storage battery B1 due to the small SOC of the lead storage battery B1 before the outboard motor engine 1 is started, for example. As an example, the auxiliary power source P includes a generator using sunlight or a spare power storage device, for example.

The voltage sensor 7*a* detects the voltage value of the outboard motor capacitor 7. That is, the voltage sensor 7*a* detects a voltage between a pair of electrodes of the outboard motor capacitor 7.

The voltage value of the outboard motor capacitor 7 detected by the voltage sensor 7*a* is acquired by the outboard motor controller 9. Then, the outboard motor controller 9 supplies, from the outboard motor capacitor 7 to the starter 4, power to start the outboard motor engine 1 based on the voltage value of the outboard motor capacitor 7, and performs a starting control to start the outboard motor engine 1 (a control to start the outboard motor engine 1 described below). The details are described below.

The relay switch 7*b* suppresses the dark current of the outboard motor capacitor 7. Specifically, the relay switch 7*b* is connected in series to the outboard motor capacitor 7, and switches between an energization state and a cutoff state between the outboard motor capacitor 7 and the starter 4.

When the outboard motor engine 1 is stopped, the relay switch 7*b* is in a cutoff state (open state) and significantly reduces or prevents discharging from the outboard motor capacitor 7. When the outboard motor engine 1 is started and driven, the relay switch 7*b* is in an energization state (closed state), and the outboard motor capacitor 7 is able to be discharged. The relay switch 7*b* is driven and controlled by the outboard motor controller 9.

Even when the outboard motor 102*a* is not used for a relatively long period of time, the relay switch 7*b* is maintained in a cutoff state such that a decrease in the SOC of the outboard motor capacitor 7 due to the dark current is minimized, and the SOC is maintained in a larger state. Therefore, the outboard motor 102*a* more reliably starts the outboard motor engine 1 using the power of the outboard motor capacitor 7.

The DC-DC converter 8 is located in the outboard motor 102*a*. Specifically, the DC-DC converter 8 is located in the cowling 6.

The DC-DC converter 8 is, for example, a buck-boost converter to mutually convert a DC voltage. That is, the DC-DC converter 8 boosts the DC voltage supplied from the lead storage battery B1 in the hull 101 to the outboard motor capacitor 7 to charge the outboard motor capacitor 7. Furthermore, the DC-DC converter 8 steps down the DC voltage generated by the generator 5 and output to the lead storage battery B1 in the hull 101 so as to charge the lead storage battery B1.

As an example, the DC-DC converter 8 boosts the DC voltage supplied from the lead storage battery B1 in the hull 101 to the outboard motor capacitor 7 to charge the outboard motor capacitor 7 from 12 [V] to 48 [V]. Furthermore, the DC-DC converter 8 steps down the DC voltage generated by the generator 5 and output to the lead storage battery B1 in the hull 101 so as to charge the lead storage battery B1 from, for example, 48 [V] to 12 [V].

The DC-DC converter 8 is switchable between an on state in which power passes through the DC-DC converter 8 and an off state (stop state) in which power does not pass through the DC-DC converter 8. That is, the DC-DC converter 8 limits an output from the outboard motor capacitor 7 to the hull 101 side (lead storage battery B1) in the off state. Furthermore, the DC-DC converter 8 limits an output from the hull 101 side (lead storage battery B1) to the outboard motor capacitor 7 in the off state. The on state and off state of the DC-DC converter 8 are switched by the outboard motor controller 9.

The outboard motor controller 9 is located in the outboard motor 102*a*. Specifically, the outboard motor controller 9 is located in the cowling 6. The outboard motor controller 9 includes a circuit board including a central processing unit (CPU), a read-only memory (ROM), a random access memory (RAM), etc., for example.

Controls performed by the outboard motor controller 9 are roughly divided into a "control at the time of starting the outboard motor engine 1" and a "control after the start (during driving) of the outboard motor engine 1". The "control at the time of starting the outboard motor engine 1" includes a "control to start the outboard motor engine 1 (cranking control)" and a "notification control at the time of starting the outboard motor engine 1". They are described below in order.

The outboard motor controller 9 supplies, from the outboard motor capacitor 7 to the starter 4, power to start (crank) the outboard motor engine 1 based on a user's "predetermined starting operation" to start the outboard motor engine 1.

As an example, the "predetermined starting operation" refers to a user's operation to change the key switch K from an off state to an on state. The predetermined starting operation is not limited to the operation related to the key switch K, but may be another operation performed by the user in advance to start the outboard motor engine 1.

The outboard motor controller 9 acquires the voltage value of the outboard motor capacitor 7 by the voltage sensor 7*a* and determines whether or not it is equal to or greater than a first threshold (49 [V], for example) when a predetermined operation to initiate the start of the outboard motor engine 1 is performed. That is, the outboard motor controller 9 determines (confirms) whether or not the outboard motor capacitor 7 is charged with power enough for the starter 4 to reliably start the outboard engine 1.

When the voltage value of the outboard motor capacitor 7 is equal to or greater than the first threshold, the outboard motor controller 9 shifts to a control to supply, from the outboard motor capacitor 7 to the starter 4, power to start the outboard motor engine 1.

On the other hand, when the voltage value of the outboard motor capacitor 7 is less than the first threshold, the outboard motor controller 9 turns on the relay switch 7*b* and the DC-DC converter 8 to start charging the outboard motor capacitor 7 from the lead storage battery B1.

Then, the outboard motor controller 9 reduces a threshold for the voltage value of the outboard motor capacitor 7 to predetermined thresholds (a second threshold, a third threshold, and a lower limit threshold) that are smaller than the first threshold in a stepwise manner while continuing to charge the outboard motor capacitor 7, and shifts from a control to charge the outboard motor capacitor 7 to a control to supply, from the outboard motor capacitor 7 to the starter 4, power to start (crank) the outboard motor engine 1 when the voltage value of the outboard motor capacitor 7 becomes equal to or greater than the predetermined thresholds.

At this time, the outboard motor controller 9 stops a supply of power from the lead storage battery B1 in the hull 101 to the outboard motor capacitor 7 to charge the outboard motor capacitor 7 by stopping the DC-DC converter 8. That is, the outboard motor controller 9 turns the DC-DC converter 8 from an on state to an off state to limit an output of the DC voltage from the lead storage battery B1 to the outboard motor capacitor 7.

Figure 5:
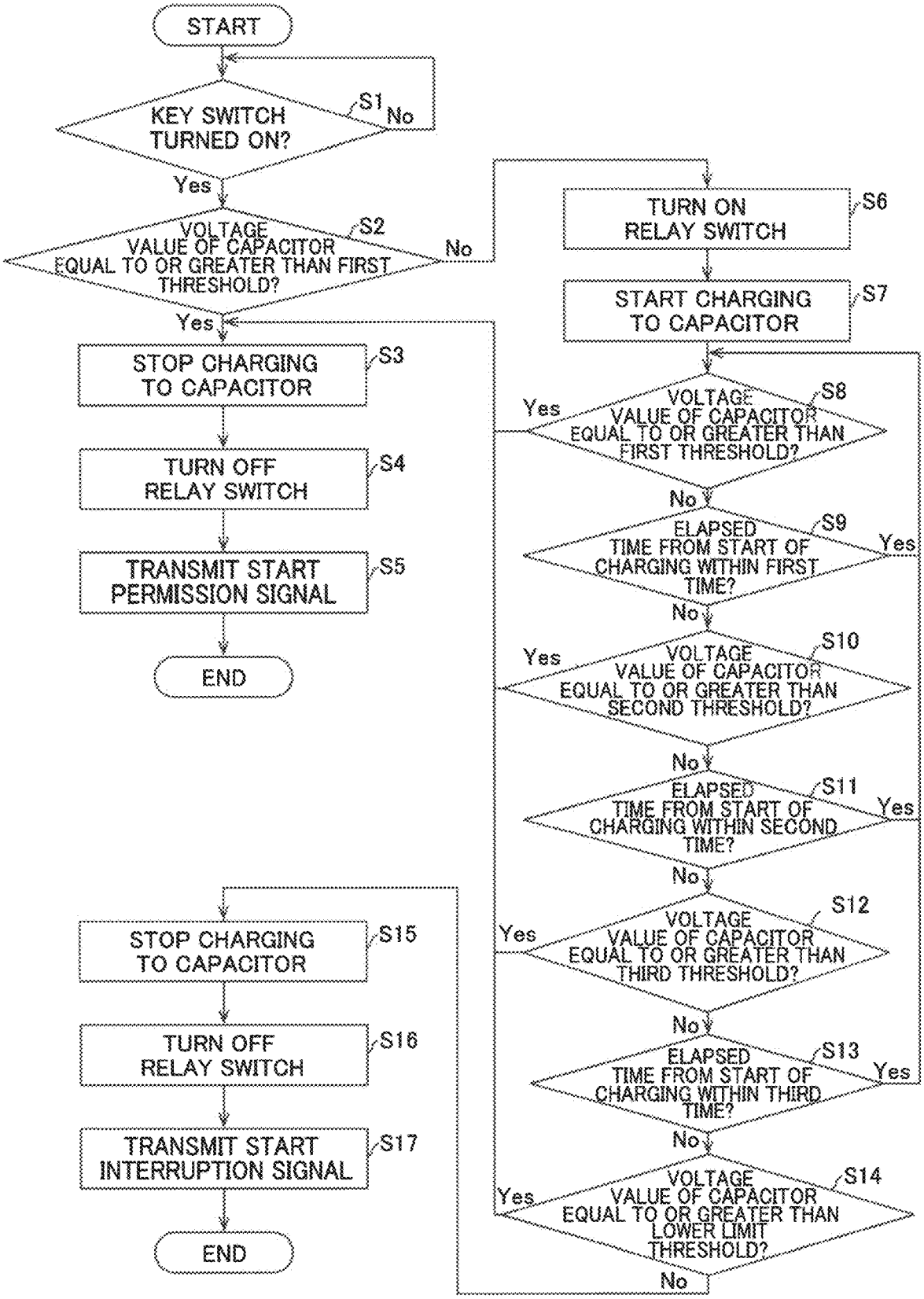
FIG. 5 is a flowchart showing a control process to start the outboard motor engine performed by an outboard motor controller according to the first preferred embodiment of the present invention.

A flow of a control process to start the outboard motor engine 1 performed by the outboard motor controller 9 is now described with reference to FIG. 5.

First, in step S1, it is determined whether or not the key switch K has been turned on. When the key switch K has been turned on, the process advances to step S2, and when the key switch K is in an off state, the process operation in step S1 is repeated.

Then, in step S2, it is determined whether or not the voltage value of the outboard motor capacitor 7 acquired by the voltage sensor 7*a* is equal to or greater than the first threshold (49 [V], for example). When it is equal to or greater than the first threshold, the process advances to step S3, and when it is less than the first threshold, the process advances to step S6.

Then, in step S3, charging to the outboard motor capacitor 7 from the lead storage battery B1 in the hull 101 is stopped. That is, the DC-DC converter 8 that electrically connects the outboard motor capacitor 7 to the lead storage battery B1 is turned off. When the DC-DC converter 8 is already in an off state, the off state is continued. Then, the process advances to step S4.

Then, in step S4, the relay switch 7*b* is turned off (opened). When the relay switch 7*b* is already in an off state, the off state is continued. Then, the process advances to step S5.

Then, in step S5, a start permission signal is transmitted. When the start permission signal is transmitted, the relay switch 7*b* is turned on (closed) again, and power is supplied from the outboard motor capacitor 7 to the starter 4 to start the outboard motor engine 1. Consequently, the outboard motor engine 1 is started.

When the process advances from step S2 to step S6, the relay switch 7*b* is turned on (closed) in step S6. Then, the process advances to step S7.

Then, in step S7, charging to the outboard motor capacitor 7 from the lead storage battery B1 is started. That is, the DC-DC converter 8 that electrically connects the outboard motor capacitor 7 to the lead storage battery B1 is turned on. Then, the process advances to step S8.

Then, in step S8, it is determined whether or not the voltage value of the outboard motor capacitor 7 acquired by the voltage sensor 7*a* is equal to or greater than the first threshold. When it is equal to or greater than the first threshold, the process advances to step S3, and when it is less than the first threshold, the process advances to step S9.

Then, in step S9, it is determined whether or not the elapsed time from the start of charging is within a first time (10 seconds, for example). When it is within the first time, the process returns to step S8, and when the first time has elapsed, the process advances to step S10. A case of advancing from step S9 to step S10 refers in short to a case in which it is difficult to reach the first threshold or greater even when charging is continued for longer than the first time (including a case in which it takes a relatively long time).

Then, in step S10, it is determined whether or not the voltage value of the outboard motor capacitor 7 acquired by the voltage sensor 7*a* is equal to or greater than the second threshold (48 [V], for example). When it is equal to or greater than the second threshold, the process advances to step S3, and when it is less than the second threshold, the process advances to step S11.

Then, in step S11, it is determined whether or not the elapsed time from the start of charging is within a second time (20 seconds, for example). When it is within the second time, the process returns to step S10, and when the second time has elapsed, the process advances to step S12. A case of advancing from step S11 to step S12 refers in short to a case in which it is difficult to reach the second threshold or greater even when charging is continued for longer than the second time (including a case in which it takes a relatively long time). Then, in step S12, it is determined whether or not the voltage value of the outboard motor capacitor 7 acquired by the voltage sensor 7*a* is equal to or greater than the third threshold (47 [V], for example). When it is equal to or greater than the third threshold, the process advances to step S3, and when it is less than the third threshold, the process advances to step S13.

Then, in step S13, it is determined whether or not the elapsed time from the start of charging is within a third time (30 seconds, for example). When it is within the third time, the process returns to step S12, and when the third time has elapsed, the process advances to step S14. A case of advancing from step S13 to step S14 refers in short to a case in which it is difficult to reach the third threshold or greater even when charging is continued for longer than the third time (including a case in which it takes a relatively long time).

Then, in step S14, it is determined whether or not the voltage value of the outboard motor capacitor 7 acquired by the voltage sensor 7*a* is equal to or greater than the lower limit threshold (46 [V], for example). When it is equal to or greater than the lower limit threshold, the process advances to step S3, and when it is less than the lower limit threshold, the process advances to step S15.

Then, in step S15, charging to the outboard motor capacitor 7 from the lead storage battery B1 is stopped. Then, the process advances to step S16.

Then, in step S16, the relay switch 7*b* is turned off (opened). Then, the process advances to step S17.

Then, in step S17, a start interruption signal is transmitted. In such a case, the user is notified by a predetermined method that the outboard motor engine 1 is not able to be started. For example, the display H1 (see FIG. 1) indicates that the outboard motor engine 1 is not able to be started.

In such a case, the outboard motor capacitor 7 is not charged by the lead storage battery B1 to the extent that the outboard motor engine 1 is started, and thus it is necessary to charge the outboard motor capacitor 7 in another manner. For example, the user electrically connects the auxiliary power source P (see FIG. 4) to the outboard motor capacitor 7, and the outboard motor capacitor 7 is charged.

The outboard motor controller 9 provides a notification to the user that the starter 4 is attempting to start the outboard motor engine 1 based on a user's predetermined starting operation to start the outboard motor engine 1. The "predetermined starting operation" refers to the operation described above.

As an example, the "notification" refers to providing on the display H1 a predetermined display that the starter 4 is attempting to start the outboard motor engine 1. Alternatively, the "notification" may be provided in another manner such as sound.

By such notification, the user does not mistakenly believe that the outboard motor engine 1 is defective even when the outboard motor engine 1 is not started immediately after the "predetermined starting operation", and is able to wait for the start of the outboard motor engine 1.

The outboard motor controller 9 shown in FIG. 3 performs a control to supply, from the generator 5 to the outboard motor capacitor 7, power to charge the outboard motor capacitor 7 during driving of the outboard motor engine 1. The outboard motor controller 9 performs a control to supply, to the lead storage battery B1 from the generator 5 via the outboard motor capacitor 7 and the DC-DC converter 8, power to charge the lead storage battery B1 during driving of the outboard motor engine 1.

That is, the outboard motor controller 9 smooths power generated by the generator 5 in the outboard motor capacitor 7, turns on the DC-DC converter 8, and outputs a DC voltage having a predetermined voltage value to the lead storage battery B1.

Figure 6:
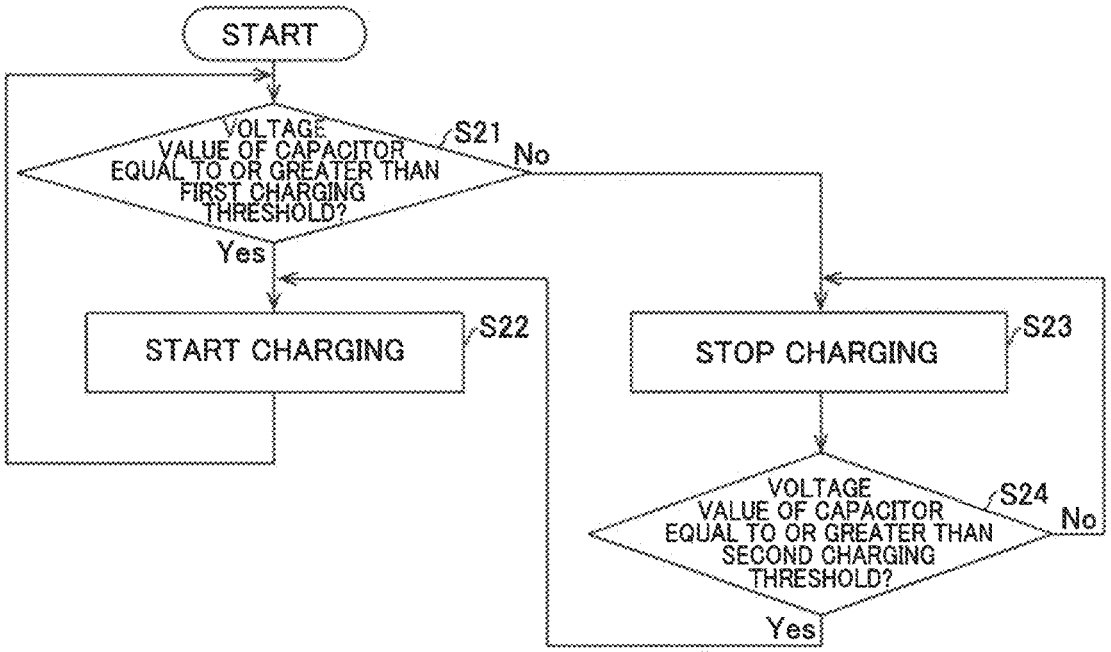
FIG. 6 is a flowchart showing a control process during driving of the outboard motor engine performed by the outboard motor controller according to the first preferred embodiment of the present invention.

A flow of a control process after the start (during driving) of the outboard motor engine 1 performed by the outboard motor controller 9 is now described with reference to FIG. 6. As an example, the expression "during driving of the outboard motor engine 1" indicates that the rotation speed of the outboard motor engine 1 is about 500 rpm or more, for example.

In step S21, it is determined whether or not the voltage value of the outboard motor capacitor 7 acquired by the voltage sensor 7*a* is equal to or greater than a first charging threshold (45 [V], for example). When it is equal to or greater than the first charging threshold, the process advances to step S22, and when it is less than the first charging threshold, the process advances to step S23.

Then, in step S22, the DC-DC converter 8 is turned on, and the output of a DC voltage having a predetermined voltage value to the lead storage battery B1 is started. That is, charging to the lead storage battery B1 is started. Consequently, power generated by the generator 5 is distributed to and charged in the outboard motor capacitor 7 and the lead storage battery B1. Then, the process returns to step S21.

Then, in step S23, the DC-DC converter 8 is turned off, and the output of a DC voltage to the lead storage battery B1 is stopped. That is, charging to the lead storage battery B1 is stopped. Consequently, power generated by the generator 5 is intensively charged in the outboard motor capacitor 7, and thus the outboard motor capacitor 7 is effectively charged. Then, the process advances to step S24.

Then, in step S24, it is determined whether or not the voltage value of the outboard motor capacitor 7 acquired by the voltage sensor 7*a* is equal to or greater than a second charging threshold (50 [V], for example). When it is equal to or greater than the second charging threshold, the process advances to step S22, and when it is less than the second charging threshold, the process returns to step S23.

According to the first preferred embodiment of the present invention, the following advantageous effects are achieved.

According to the first preferred embodiment of the present invention, the marine propulsion system 102 includes the outboard motor capacitor 7 provided in the outboard motor 102*a* to supply to the starter 4 power to start the outboard motor engine 1, and having a higher output per unit volume than the lead storage battery. Accordingly, the outboard motor capacitor 7 having a higher output per unit volume than the lead storage battery supplies to the starter 4 power to start the outboard motor engine 1, and thus while an output equal to or higher than that of the lead storage battery is provided, a power source (outboard motor capacitor 7) for the starter 4 is downsized and installed in the outboard motor 102*a*. Consequently, it is not necessary to provide a power source for the starter 4 on the hull 101, and thus a space for the house device H is increased in the hull without expanding the space in the hull. In general, a capacitor has a property that a decrease in output due to a decrease in charging rate is smaller (a range of a charging rate at which the outboard motor engine 1 is able to be started is larger) and a decrease in maximum output due to repeated charging is smaller (the capacitor is harder to deteriorate) as compared with a lead storage battery. Therefore, as compared with the lead storage battery, the starting of the outboard motor engine 1 is improved. Thus, a space for the house device H is increased in the hull without expanding the space in the hull, and the starting of the outboard motor engine 1 is improved. Furthermore, the outboard motor capacitor 7 is located in the outboard motor 102*a* such that it is not necessary to provide a wiring (a wiring to directly supply to the starter 4 power to start the outboard motor engine 1) so as to extend between the hull 101 and the outboard motor 102*a*. Thus, a complex operation such as routing of the wiring is eliminated, and a load (stress) applied to the wiring at the time of steering is prevented.

According to the first preferred embodiment of the present invention, the outboard motor 102*a* includes the cowling 6 to house the outboard motor engine 1, and the outboard motor capacitor 7 is provided in the cowling 6. Accordingly, the outboard motor capacitor 7 is located in the cowling 6 in the uppermost portion of the outboard motor 102*a*, and thus adhesion of water to the outboard motor capacitor 7 is prevented.

According to the first preferred embodiment of the present invention, the marine propulsion system 102 further includes the outboard motor controller 9 provided in the outboard motor 102*a* and configured or programmed to control driving of the outboard motor engine 1, and the generator 5 provided in the outboard motor 102*a* to generate power by driving of the outboard motor engine 1, and the outboard motor controller 9 is configured or programmed to perform a control to supply, from the generator 5 to the outboard motor capacitor 7, power to charge the outboard motor capacitor 7 during driving of the outboard motor engine 1. Accordingly, the outboard motor capacitor 7 is charged by the generator 5 during driving of the outboard motor engine 1, and thus the outboard motor engine 1 is continuously and repeatedly started by the outboard motor capacitor 7.

According to the first preferred embodiment of the present invention, the marine propulsion system 102 further includes the hull-side battery (lead storage battery B1) provided on the hull 101 and electrically connected to the outboard motor capacitor 7, and the outboard motor controller 9 is configured or programmed to perform a control to supply, from the hull-side battery to the outboard motor capacitor 7, power to charge the outboard motor capacitor 7 before driving of the outboard motor engine 1. Accordingly, when the outboard motor capacitor 7 is discharged while the outboard motor engine 1 is stopped and the charging rate of the outboard motor capacitor 7 is decreased, for example, the outboard motor capacitor 7 is charged by the hull-side battery even before the outboard motor engine 1 is driven although the outboard motor capacitor 7 is not charged by the generator 5. Consequently, the starting of the outboard motor engine 1 is further improved. The hull-side battery is provided, and thus the wiring W (the wiring connected to the hull-side battery) that extends between the hull 101 and the outboard motor 102*a* is required. However, power output via the wiring W is not power to start the outboard motor engine 1 but power to charge the outboard motor capacitor 7 having a lower output than the power to start the outboard motor engine 1, and thus a relatively thin wiring W is used as the wiring connected to the hull-side battery. Therefore, an operation such as routing of the wiring W is relatively easy, and a load (stress) applied to the wiring at the time of steering is relatively decreased.

According to the first preferred embodiment of the present invention, the marine propulsion system 102 further includes the voltage sensor 7*a* provided in the outboard motor 102*a* to detect the voltage value of the outboard motor capacitor 7, and the outboard motor controller 9 is configured or programmed to perform a control to supply, from the outboard motor capacitor 7 to the starter 4, power to start the outboard motor engine 1 when the voltage value of the outboard motor capacitor 7 is equal to or greater than the first threshold; to supply, from the hull-side battery (lead storage battery B1) to the outboard motor capacitor 7, power to charge the outboard motor capacitor 7 when the voltage value of the outboard motor capacitor 7 is less than the first threshold; and to supply, from the outboard motor capacitor 7 to the starter 4, power to start the outboard motor engine 1 when the voltage value of the outboard motor capacitor 7 becomes equal to or greater than the first threshold before the first time elapses after the supply of the power to charge the outboard motor capacitor 7 from the hull-side battery is started. Accordingly, after the voltage value of the outboard motor capacitor 7 is increased to a value that is equal to or greater than the first threshold by charging that requires a maximum of the first time such that the outboard motor engine 1 is reliably started, the outboard motor capacitor 7 supplies to the starter 4 the power to start the outboard motor engine 1.

According to the first preferred embodiment of the present invention, the outboard motor controller 9 is configured or programmed to perform a control to continuously supply, from the hull-side battery (lead storage battery B1) to the outboard motor capacitor 7, power to charge the outboard motor capacitor 7 when the voltage value of the outboard motor capacitor 7 is less than the first threshold at the expiration of the first time, and to supply, from the outboard motor capacitor 7 to the starter 4, power to start the outboard motor engine 1 when the voltage value of the outboard motor capacitor 7 becomes equal to or greater than the second threshold that is smaller than the first threshold before the second time that is longer than the first time elapses after the supply of the power to charge the outboard motor capacitor 7 from the hull-side battery is started. Accordingly, even when the voltage value of the outboard motor capacitor 7 is not increased to a value that is equal to or greater than the first threshold by charging, the outboard motor capacitor 7 supplies, to the starter 4, power to start the outboard motor engine 1 after the voltage value of the outboard motor capacitor 7 is increased to a value that is equal to or greater than the second threshold such that the starting of the outboard motor engine 1 is increased by charging that requires a maximum of the second time.

According to the first preferred embodiment of the present invention, the outboard motor controller 9 is configured or programmed to perform a control to continuously supply, from the hull-side battery (lead storage battery B1) to the outboard motor capacitor 7, power to charge the outboard motor capacitor 7 when the voltage value of the outboard motor capacitor 7 is less than the second threshold at the expiration of the second time, and to supply, from the outboard motor capacitor 7 to the starter 4, power to start the outboard motor engine 1 when the voltage value of the outboard motor capacitor 7 becomes equal to or greater than the third threshold that is smaller than the second threshold before the third time that is longer than the second time elapses after the supply of the power to charge the outboard motor capacitor 7 from the hull-side battery is started. Accordingly, even when the voltage value of the outboard motor capacitor 7 is not increased to a value that is equal to or greater than the second threshold by charging, the outboard motor capacitor 7 supplies to the starter 4 power to start the outboard motor engine 1 after the voltage value of the outboard motor capacitor 7 is increased to a value that is equal to or greater than the third threshold such that the starting of the outboard motor engine 1 is increased by charging that requires a maximum of the third time.

According to the first preferred embodiment of the present invention, the outboard motor controller 9 is configured or programmed to perform a control to supply, from the hull-side battery (lead storage battery B1) to the outboard motor capacitor 7, power to charge the outboard motor capacitor 7, and to interrupt the start of the outboard motor engine 1 when it is determined that the voltage value of the outboard motor capacitor 7 detected by the voltage sensor 7*a* does not become equal to or greater than the lower limit threshold that is smaller than the third threshold as a result of the supply of the power to charge the outboard motor capacitor 7 from the hull-side battery. Accordingly, even when charging is continued, it is determined at the appropriate timing that it is difficult to set the voltage value (charging rate) of the outboard motor capacitor 7 to be equal to or greater than the lower limit threshold (the lower limit voltage value at which the outboard motor engine 1 is started), and the start of the outboard motor engine 1 is interrupted.

According to the first preferred embodiment of the present invention, the marine propulsion system 102 further includes the DC-DC converter 8 provided in the outboard motor 102*a* to boost the DC voltage supplied from the hull-side battery (lead storage battery B1) to the outboard motor capacitor 7 to charge the outboard motor capacitor 7, and the outboard motor controller 9 is configured or programmed to stop the supply of the power to charge the outboard motor capacitor 7 from the hull-side battery by stopping the DC-DC converter 8. Accordingly, the DC-DC converter 8 is stopped (turned off) such that the outboard motor capacitor 7 supplies to the starter 4 power to start the outboard motor engine 1 while a cutoff between the hull-side battery and the outboard motor capacitor 7 is provided. Therefore, when power is supplied to start the outboard motor engine 1, the waste of power output to the hull-side battery via the DC-DC converter 8 is eliminated.

According to the first preferred embodiment of the present invention, the hull-side battery (lead storage battery B1) is a dedicated capacitor battery to supply, to the outboard motor capacitor 7, power to charge the outboard motor capacitor 7. Accordingly, the power of the hull-side battery is not consumed except for the purpose of charging the outboard motor capacitor 7, and the power consumption of the hull-side battery is significantly reduced. Consequently, the outboard motor capacitor 7 is more reliably charged by the hull-side battery, and thus the starting of the outboard motor engine 1 is further improved.

According to the first preferred embodiment of the present invention, the capacitor battery includes the lead storage battery B1. Unlike a conventional lead storage battery on the hull used for a high output to directly supply to a starter power to start an outboard motor engine, the lead storage battery B1 on the hull 101 side according to preferred embodiments of the present invention is used for a low output to supply, to the outboard motor capacitor 7, power to charge the outboard motor capacitor 7, and thus the size of the lead storage battery B1 is relatively decreased. Therefore, with the structure described above, even when the lead storage battery B1 is provided on the hull 101, the lead storage battery B1 is small, and thus a space for the house device H is increased in the hull without expanding the space in the hull.

According to the first preferred embodiment of the present invention, the outboard motor controller 9 is configured or programmed to provide a notification to the user that the starter 4 is attempting to start the outboard motor engine 1 based on a user's predetermined starting operation to start the outboard motor engine 1. Accordingly, when it takes time to charge the outboard motor capacitor 7 with the hull-side battery (lead storage battery B1), for example, the user recognizes that the outboard motor engine 1 is in the process of being started due to the notification, and thus the user is prevented from erroneously believing that the outboard motor engine 1 is defective, for example.

According to the first preferred embodiment of the present invention, the marine propulsion system 102 further includes the relay switch 7*b* to switch between the energization state and the cutoff state between the outboard motor capacitor 7 and the starter 4. Accordingly, the relay switch 7*b* is maintained in the cutoff state while the outboard motor engine 1 is stopped such that the dark current of the outboard motor capacitor 7 (discharging from the outboard motor capacitor 7) is suppressed.

According to the first preferred embodiment of the present invention, the outboard motor capacitor 7 is electrically connectable to the auxiliary power source P, and the auxiliary power source P supplies, to the outboard motor capacitor 7, power to charge the outboard motor capacitor 7. Accordingly, when the outboard motor capacitor 7 is discharged while the outboard motor engine 1 is stopped and the charging rate is decreased, for example, the outboard motor capacitor 7 is charged by the auxiliary power source P. Consequently, the starting of the outboard motor engine 1 is further improved.

Second Preferred Embodiment

Figure 7:
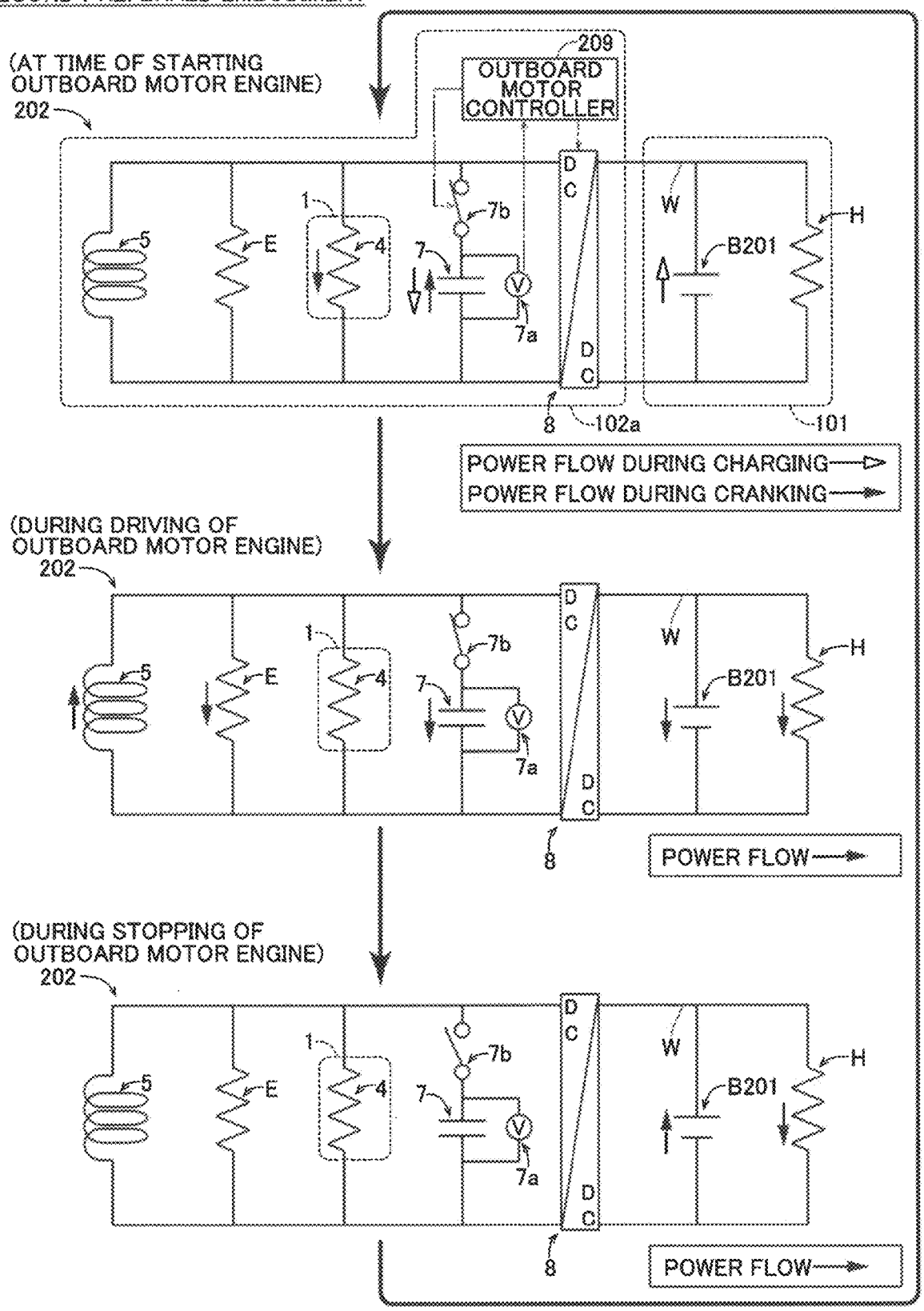
FIG. 7 is a diagram schematically showing a circuit including an outboard motor capacitor of a marine propulsion system and a starter for an outboard motor engine according to a second preferred embodiment of the present invention.

A second preferred embodiment of the present invention is now described with reference to FIG. 7. In the second preferred embodiment, a lead storage battery B201 in a hull 101 is used not only to charge an outboard motor capacitor 7 but also to drive a house device H, unlike the first preferred embodiment in which the lead storage battery B1 in the hull 101 is used only to charge the outboard motor capacitor 7. In short, in the second preferred embodiment, the lead storage battery B201 and the house device H are provided in the same circuit that is electrically connected. The same or similar structures as those of the first preferred embodiment are denoted by the same reference numerals, and description thereof is omitted as appropriate. The lead storage battery B201 is an example of a "capacitor battery" or a "hull-side battery".

A marine propulsion system 202 according to the second preferred embodiment includes an outboard motor 102*a* and the lead storage battery B201.

The lead storage battery B201 is electrically connected to the house device H, and supplies power to the house device H.

The outboard motor 102*a* includes an outboard motor controller 209. The outboard motor controller 209 is configured or programmed to perform a control to supply, from the outboard motor capacitor 7 to a starter 4, power to start an outboard motor engine 1 based on a user's predetermined starting operation to start the outboard motor engine 1. Furthermore, the outboard motor controller 209 is configured or programmed to perform a control to supply, from the lead storage battery B201 to the house device H, power to drive the house device H, as described above.

The lead storage battery B201 is electrically connected to the house device H, and thus power is constantly supplied to the house device H to drive the house device H regardless of whether the outboard motor engine 1 is driven or not. The marine propulsion system 202 may limit supply to the house device H of power to drive the house device H according to the SOC of the lead storage battery B201.

The remaining structures of the second preferred embodiment are similar to those of the first preferred embodiment.

According to the second preferred embodiment of the present invention, the following advantageous effects are achieved.

According to the second preferred embodiment of the present invention, the marine propulsion system 202 includes the outboard motor capacitor 7 provided in the outboard motor 102*a* to supply to the starter 4 power to start the outboard motor engine 1, and having a higher output per unit volume than the lead storage battery. Accordingly, similarly to the first preferred embodiment, a space for the house device H is increased in the hull without expanding the space in the hull, and the starting of the outboard motor engine 1 is improved.

According to the second preferred embodiment of the present invention, the outboard motor controller 209 is configured or programmed to provide a notification to a user that the starter 4 is attempting to start the outboard motor engine 1 based on a user's predetermined starting operation to start the outboard motor engine 1. Accordingly, when it takes time to charge the outboard motor capacitor 7 with the hull-side battery (lead storage battery B201), for example, the user recognizes that the outboard motor engine 1 is in the process of being started due to the notification, and thus the user is prevented from erroneously believing that the outboard motor engine 1 is defective, for example.

Third Preferred Embodiment

Figure 8:
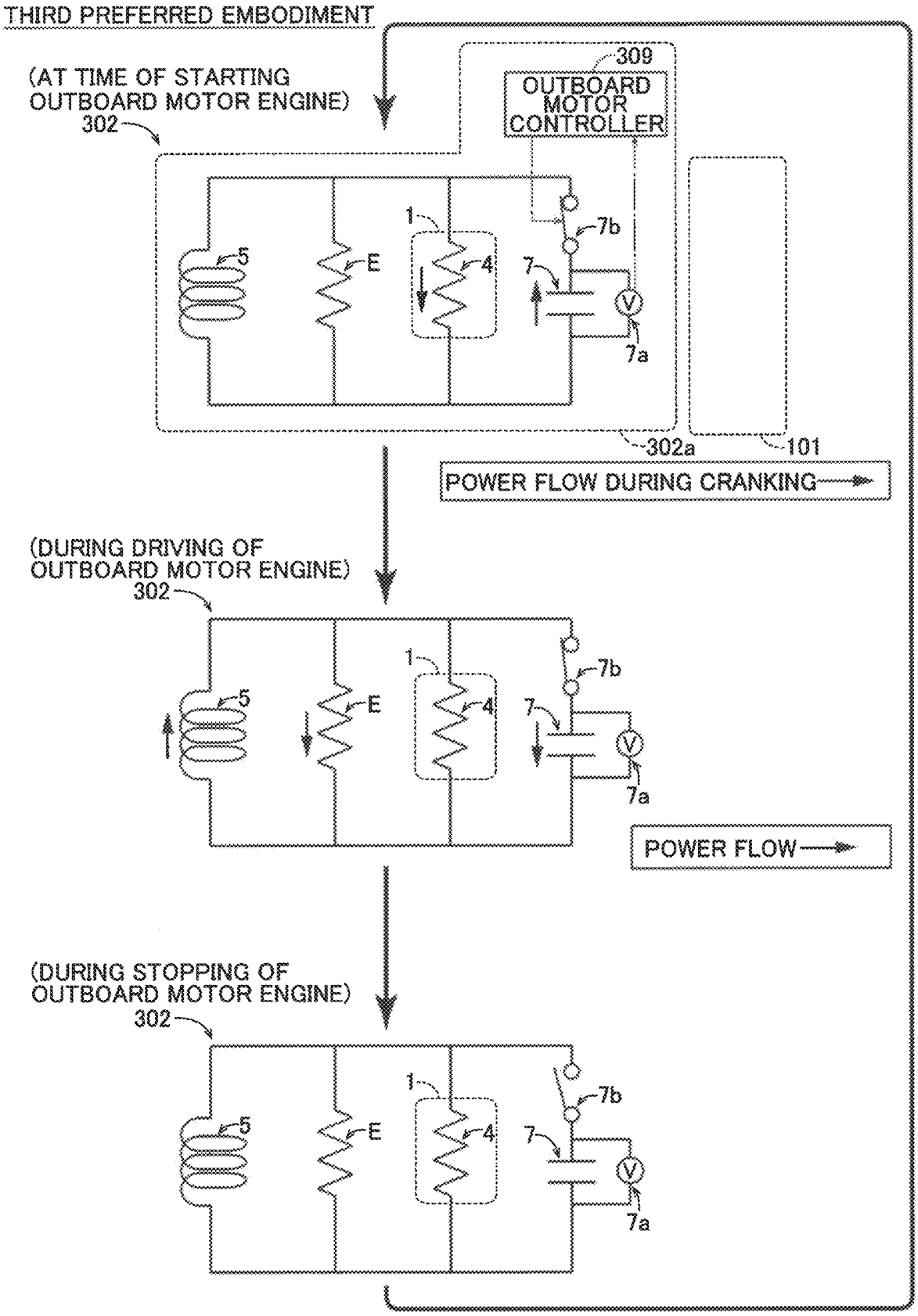
FIG. 8 is a diagram schematically showing a circuit including an outboard motor capacitor of a marine propulsion system and a starter for an outboard motor engine according to a third preferred embodiment of the present invention.

A third preferred embodiment of the present invention is now described with reference to FIG. 8. In the third preferred embodiment, a marine propulsion system 302 does not include a lead storage battery in a hull 101, unlike the first preferred embodiment in which the marine propulsion system 102 includes the lead storage battery B1 in the hull 101. The same or similar structures as those of the first preferred embodiment are denoted by the same reference numerals, and description thereof is omitted as appropriate.

The marine propulsion system 302 according to the third preferred embodiment includes an outboard motor 302*a* including an outboard motor controller 309. Unlike the outboard motor 102*a* according to the first preferred embodiment, the outboard motor 302*a* does not include a DC-DC converter.

The outboard motor controller 309 is configured or programmed to perform a control to supply, from an outboard motor capacitor 7 to a starter 4, power to start an outboard motor engine 1 based on a user's predetermined starting operation to start the outboard motor engine 1.

The outboard motor controller 9 according to the first preferred embodiment is configured or programmed to perform a control to charge the outboard motor capacitor 7 before starting (cranking) the outboard motor engine 1 as needed based on a user's predetermined starting operation to start the outboard motor engine 1, but the outboard motor controller 309 is configured or programmed to perform a control to immediately supply, from the outboard motor capacitor 7 to the starter 4, power to start the outboard motor engine 1 based on a user's predetermined starting operation to start the outboard motor engine 1. That is, the marine propulsion system 302 does not include a device to directly charge the outboard motor capacitor 7 before the start of the outboard motor engine 1.

In consideration of the possibility that the SOC of the outboard motor capacitor 7 becomes small and the outboard motor engine 1 is not able to be started by the outboard motor capacitor 7, the hull 101 including the marine propulsion system 302 includes a predetermined device to return to the port.

As an example, the hull 101 includes a device to start the outboard motor engine 1 by a manual operation such as an emergency start rope as the predetermined device to return to the port. Alternatively, as the predetermined device to return to the port, a separate outboard motor may be provided, oars for rowing may be provided, or a predetermined communicator may be provided to call for support. As described in the first preferred embodiment, an auxiliary power source P may be mounted on the hull 101 to charge the outboard motor capacitor 7.

The remaining structures of the third preferred embodiment are similar to those of the first preferred embodiment.

According to the third preferred embodiment of the present invention, the following advantageous effects are achieved.

According to the third preferred embodiment of the present invention, the marine propulsion system 302 includes the outboard motor capacitor 7 provided in the outboard motor 302*a* to supply to the starter 4 power to start the outboard motor engine 1, and having a higher output per unit volume than the lead storage battery. Accordingly, similarly to the first preferred embodiment, a space for a house device H is increased in the hull without expanding the space in the hull, and the starting of the outboard motor engine 1 is improved.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the hull-side battery preferably includes a lead storage battery in each of the first and second preferred embodiments described above, the present invention is not restricted to this. In the present invention, the hull-side battery may alternatively include a different type of battery than a lead storage battery, such as a lithium-ion battery.

While one outboard motor is preferably provided on the hull in each of the first to third preferred embodiments described above, the present invention is not restricted to this. In the present invention, a plurality of outboard motors may alternatively be provided on the hull.

While the outboard motor preferably includes the DC-DC converter in each of the first and second preferred embodiments described above, the present invention is not restricted to this. In the present invention, the outboard motor may not include the DC-DC converter.

While the outboard motor capacitor is preferably charged based on four thresholds (the first to third thresholds and the lower limit threshold) when the outboard motor engine is started in each of the first and second preferred embodiments described above, the present invention is not restricted to this. In the present invention, when the outboard motor engine is started, the outboard motor capacitor may alternatively be charged based on one threshold, two thresholds, three thresholds, or five or more thresholds.

While the outboard motor controller preferably performs a control to interrupt the start of the outboard motor engine when the voltage value of the outboard motor capacitor is less than the lower limit threshold even when the outboard motor capacitor is continuously charged for the third time at the time of starting the outboard motor engine in each of the first and second preferred embodiments described above, the present invention is not restricted to this. In the present invention, the outboard motor controller may alternatively perform a control to continue charging until the voltage value of the outboard motor capacitor becomes equal to or greater than the lower limit threshold without interrupting the start of the outboard motor engine.

While the outboard motor capacitor is preferably provided in the cowling in each of the first to third preferred embodiments described above, the present invention is not restricted to this. In the present invention, the outboard motor capacitor may alternatively be provided at a position different from the cowling, such as an upper case.

While the outboard motor preferably includes only the outboard motor engine as a drive source to drive the propulsion generator in each of the first to third preferred embodiments described above, the present invention is not restricted to this. In the present invention, the outboard motor may alternatively include an electric motor in addition to the outboard motor engine as a drive source to drive the propulsion generator. That is, the outboard motor may be a so-called hybrid outboard motor.

While the process operations performed by the outboard motor controller are described using flowcharts in a flow-driven manner in which processes are performed in order along a process flow for the convenience of illustration in each of the first to third preferred embodiments described above, the present invention is not restricted to this. In the present invention, the process operations performed by the outboard motor controller may alternatively be performed in an event-driven manner in which the processes are performed on an event basis. In this case, the process operations performed by the outboard motor controller may be performed in a complete event-driven manner or in a combination of an event-driven manner and a flow-driven manner.

While preferred embodiments of the present invention have been described above, variations and modifications will be apparent to those skilled in the art without departing from the scope and spirit of the present invention. The scope of the present invention, therefore, is to be determined solely by the following claims.

What is claimed is:

1. A marine propulsion system comprising:

an outboard motor including an outboard motor engine, a propulsion generator to be driven by the outboard motor engine, and an electric starter to start the outboard motor engine, the outboard motor being installed on a hull;

an outboard motor capacitor provided in the outboard motor to supply to the starter power to start the outboard motor engine, the outboard motor capacitor having a higher output per unit volume than a lead storage battery;

a hull-side battery provided on the hull and electrically connected to the outboard motor capacitor; and an outboard motor controller provided in the outboard motor and configured or programmed to control driving of the outboard motor engine; wherein the hull-side battery is configured to supply to the outboard motor capacitor power to charge the outboard motor capacitor after an operation to start the outboard motor engine and before the engine is started; and the outboard motor controller is configured or programmed to, in a stepwise manner, reduce a threshold for a voltage value of the outboard motor capacitor to start the outboard motor engine while the outboard motor engine is stopped.

2. The marine propulsion system according to claim 1, wherein the outboard motor further includes a cowling to house the outboard motor engine; and the outboard motor capacitor is provided in the cowling.

3. The marine propulsion system according to claim 1, further comprising:

a generator provided in the outboard motor to generate power due to the driving of the outboard motor engine; wherein the outboard motor controller is configured or programmed to perform a control to supply, from the generator to the outboard motor capacitor, power to charge the outboard motor capacitor during the driving of the outboard motor engine.

4. The marine propulsion system according to claim 3, wherein the outboard motor controller is configured or programmed to perform a control to supply, from the hull-side battery to the outboard motor capacitor, the power to charge the outboard motor capacitor before the driving of the outboard motor engine.

5. The marine propulsion system according to claim 4, further comprising:

a voltage sensor provided in the outboard motor to detect the voltage value of the outboard motor capacitor; wherein the outboard motor controller is configured or programmed to perform a control to:

supply, from the outboard motor capacitor to the starter, the power to start the outboard motor engine when the voltage value of the outboard motor capacitor is equal to or greater than a first threshold;

supply, from the hull-side battery to the outboard motor capacitor, the power to charge the outboard motor capacitor when the voltage value of the outboard motor capacitor is less than the first threshold; and supply, from the outboard motor capacitor to the starter, the power to start the outboard motor engine when the voltage value of the outboard motor capacitor becomes equal to or greater than the first threshold before a first time elapses after the supply of the power to charge the outboard motor capacitor from the hull-side battery is started.

6. The marine propulsion system according to claim 5, wherein the outboard motor controller is configured or programmed to perform a control to:

continuously supply, from the hull-side battery to the outboard motor capacitor, the power to charge the outboard motor capacitor when the voltage value of the outboard motor capacitor is less than the first threshold at an expiration of the first time; and supply, from the outboard motor capacitor to the starter, the power to start the outboard motor engine when the voltage value of the outboard motor capacitor becomes equal to or greater than a second threshold that is smaller than the first threshold before a second time that is longer than the first time elapses after the supply of the power to charge the outboard motor capacitor from the hull-side battery is started.

7. The marine propulsion system according to claim 6, wherein the outboard motor controller is configured or programmed to perform a control to:

continuously supply, from the hull-side battery to the outboard motor capacitor, the power to charge the outboard motor capacitor when the voltage value of the outboard motor capacitor is less than the second threshold at an expiration of the second time; and supply, from the outboard motor capacitor to the starter, the power to start the outboard motor engine when the voltage value of the outboard motor capacitor becomes equal to or greater than a third threshold that is smaller than the second threshold before a third time that is longer than the second time elapses after the supply of the power to charge the outboard motor capacitor from the hull-side battery is started.

8. The marine propulsion system according to claim 7, wherein the outboard motor controller is configured or programmed to perform a control to:

supply, from the hull-side battery to the outboard motor capacitor, the power to charge the outboard motor capacitor; and interrupt the start of the outboard motor engine when it is determined that the voltage value of the outboard motor capacitor detected by the voltage sensor has not become equal to or greater than a lower limit threshold that is smaller than the third threshold as a result of the supply of the power to charge the outboard motor capacitor from the hull-side battery to the outboard motor capacitor.

9. The marine propulsion system according to claim 4, further comprising:

a DC-DC converter provided in the outboard motor to boost a DC voltage supplied from the hull-side battery to the outboard motor capacitor to charge the outboard motor capacitor; wherein the outboard motor controller is configured or programmed to stop the supply of the power to charge the outboard motor capacitor from the hull-side battery by stopping the DC-DC converter.

10. The marine propulsion system according to claim 4, wherein the hull-side battery is a dedicated capacitor battery to supply, to the outboard motor capacitor, the power to charge the outboard motor capacitor.

11. The marine propulsion system according to claim 10, wherein the capacitor battery includes the lead storage battery.

12. The marine propulsion system according to claim 4, wherein the hull-side battery supplies power to a device on the hull.

13. The marine propulsion system according to claim 3, wherein the outboard motor controller is configured or programmed to provide a notification to a user that the starter is attempting to start the outboard motor engine based on a user's predetermined starting operation to start the outboard motor engine.

14. The marine propulsion system according to claim 1, further comprising:

a relay switch to switch between an energization state and a cutoff state between the outboard motor capacitor and the starter.

15. The marine propulsion system according to claim 1, wherein the outboard motor capacitor is electrically connectable to an auxiliary power source; and the auxiliary power source supplies, to the outboard motor capacitor, power to charge the outboard motor capacitor.

16. An outboard motor comprising:

an outboard motor engine;

a propulsion generator to be driven by the outboard motor engine;

an electric starter to start the outboard motor engine;

an outboard motor capacitor to supply to the starter power to start the outboard motor engine, the outboard motor capacitor having a higher output per unit volume than a lead storage battery;

a hull-side battery provided on the hull and electrically connected to the outboard motor capacitor; and an outboard motor controller configured or programmed to control driving of the outboard motor engine; wherein the hull-side battery is configured to supply to the outboard motor capacitor power to charge the outboard motor capacitor after an operation to start the outboard motor engine and before the engine is started; and the outboard motor controller is configured or programmed to, in a stepwise manner, reduce a threshold for a voltage value of the outboard motor capacitor to start the outboard motor engine while the outboard motor engine is stopped.

17. The outboard motor according to claim 16, further comprising:

a cowling to house the outboard motor engine; wherein the outboard motor capacitor is provided in the cowling.

18. The outboard motor according to claim 16, further comprising:

a generator to generate power by the driving of the outboard motor engine; wherein the outboard motor controller is configured or programmed to perform a control to supply, from the generator to the outboard motor capacitor, power to charge the outboard motor capacitor during the driving of the outboard motor engine.

19. A marine vessel comprising:

a hull;

an outboard motor including an outboard motor engine, a propulsion generator to be driven by the outboard motor engine, and an electric starter to start the outboard motor engine, the outboard motor being installed on the hull;

an outboard motor capacitor provided in the outboard motor to supply to the starter power to start the outboard motor engine, the outboard motor capacitor having a higher output per unit volume than a lead storage battery;

a hull-side battery provided on the hull and electrically connected to the outboard motor capacitor; and an outboard motor controller configured or programmed to control driving of the outboard motor engine; wherein the hull-side battery is configured to supply to the outboard motor capacitor power to charge the outboard motor capacitor after an operation to start the outboard motor engine and before the engine is started; and the outboard motor controller is configured or programmed to, in a stepwise manner, reduce a threshold for a voltage value of the outboard motor capacitor to start the outboard motor engine while the outboard motor engine is stopped.

20. The marine vessel according to claim 19, wherein the outboard motor further includes a cowling to house the outboard motor engine; and the outboard motor capacitor is provided in the cowling.

* * * * *